US009988203B2

(12) United States Patent
Bajrami et al.

(10) Patent No.: US 9,988,203 B2
(45) Date of Patent: Jun. 5, 2018

(54) PRIZE PACKAGES CONTAINING MATH TEACHING TOOLS AND EDIBLE CONFECTIONERY ITEMS

(71) Applicants: Besnik Bajrami, Jackson, NJ (US); Arslan Bajrami, Jackson, NJ (US); Sokol Bajrami, Jackson, NJ (US)

(72) Inventors: Besnik Bajrami, Jackson, NJ (US); Arslan Bajrami, Jackson, NJ (US); Sokol Bajrami, Jackson, NJ (US)

( * ) Notice: Subject to any disclaimer, the term of this patent is extended or adjusted under 35 U.S.C. 154(b) by 421 days.

(21) Appl. No.: 14/658,160

(22) Filed: Mar. 14, 2015

(65) Prior Publication Data

US 2015/0266662 A1 Sep. 24, 2015

Related U.S. Application Data

(60) Provisional application No. 62/007,496, filed on Jun. 4, 2014, provisional application No. 61/955,887, filed on Mar. 20, 2014.

(51) Int. Cl.

| | |
|---|---|
| ***B65D 85/60*** | (2006.01) |
| ***B65D 59/04*** | (2006.01) |
| ***B65D 75/32*** | (2006.01) |
| ***B65D 41/00*** | (2006.01) |

(52) U.S. Cl.

CPC ..... *B65D 85/60* (2013.01); *B65D 41/00* (2013.01); *B65D 59/04* (2013.01); *B65D 75/327* (2013.01); *B65D 2203/00* (2013.01); *B65D 2203/06* (2013.01)

(58) Field of Classification Search

CPC . B65D 85/60; B65D 41/00; A63F 2001/0466; A63F 3/0605; G09B 23/02

USPC ..... 273/138.1, 302, 269, 153 R; 434/191

See application file for complete search history.

(56) References Cited

U.S. PATENT DOCUMENTS

| | | | | |
|---|---|---|---|---|
| 2,380,367 A | | 7/1945 | Ranney | |
| 2,778,519 A | | 1/1957 | McFarlane | |
| 4,157,143 A | | 6/1979 | Doi | |
| 4,203,240 A | * | 5/1980 | Goodwin | A63F 3/065 283/56 |
| 4,559,729 A | * | 12/1985 | White | B65D 17/00 220/906 |
| 4,911,320 A | | 3/1990 | Howes | |
| 5,076,433 A | | 12/1991 | Howes | |
| 5,375,704 A | | 12/1994 | Focke et al. | |

(Continued)

*Primary Examiner* — Melba Bumgarner
*Assistant Examiner* — Rayshun Peng
(74) *Attorney, Agent, or Firm* — Doherty IP Law Group LLC

(57) ABSTRACT

A prize package containing edible confectionery items, such as gum, candy or mints, includes a container, a plurality of edible confectionery items disposed within the container, a number provided on each edible confectionery item disposed within the container, and a reference number provided inside the container. The prize package is a winning prize package if the sum total of the numbers provided on the edible confectionery items disposed within the container matches the reference number provided inside the container. A validation code is provided inside the container for confirming that the prize package is a winning prize package. The validation code may be a bar code, a number code, a QR code, or scratch-off code. The container may be made of paper or plastic, and may have a sleeve or tube shape.

13 Claims, 7 Drawing Sheets

(56) References Cited

U.S. PATENT DOCUMENTS

| | | | | |
|---|---|---|---|---|
| 5,806,707 | A | 9/1998 | Boehm et al. | |
| 5,806,852 | A * | 9/1998 | Howes | A63F 9/00 273/138.1 |
| 5,896,686 | A | 4/1999 | Howes | |
| 5,949,042 | A | 9/1999 | Dietz, II et al. | |
| 5,957,279 | A | 9/1999 | Howes | |
| 5,980,258 | A * | 11/1999 | Kohlberg | G09B 1/30 434/195 |
| 6,230,474 | B1 | 5/2001 | Giacoman | |
| 6,237,843 | B1 | 5/2001 | Falat et al. | |
| 6,763,971 | B1 * | 7/2004 | Tong | G07F 11/44 221/151 |
| 2003/0080015 | A1 | 5/2003 | Kopecky | |
| 2005/0184457 | A1 * | 8/2005 | Frieman | A63F 1/02 273/146 |
| 2013/0017880 | A1 * | 1/2013 | Fisk | G07F 17/32 463/19 |

* cited by examiner

PRIZE PACKAGES CONTAINING MATH TEACHING TOOLS AND EDIBLE CONFECTIONERY ITEMS

CROSS-REFERENCE TO RELATED APPLICATIONS

The present application claims benefit of U.S. Provisional Application Ser. No. 62/007,496 filed Jun. 4, 2014, and U.S. Provisional Application Ser. No. 61/955,887 filed Mar. 20, 2014, the disclosures of which are hereby incorporated by reference herein.

BACKGROUND OF THE INVENTION

Field of the Invention

The present invention generally relates to packages containing prizes and promotional items, and more particularly relates to promotional systems including prize packages containing match teaching tools and edible confectionery items such as gum, gum balls, candies and mints.

Description of the Related Art

There have been many efforts directed to providing food or candy product containers that incorporate prizes or promotions. For example, U.S. Pat. No. 4,911,321 to Borchardt teaches a unique marketing approach wherein actual cash awards are secretly retained in food product containers for wet or moist products such as soda, water, beer, milk, yogurt and the like. A nationwide promotion was conducted employing the teachings of this patent, which produced overwhelming consumer excitement and commercial success.

U.S. Pat. No. 5,076,433 to Howes discloses food product containers that secretly retain a prize award, while being indistinguishable from non-prize bearing products. As such, the prize-bearing product may be randomly distributed with conventional, non-prize bearing products, without having the existence of a prize-bearing product being discovered before opening by the consumer. By creating a prize retaining zone which is secretly and undiscoverably embedded in conventional food delivery products such as cups, straws, holders, and containers, prize awards, such as cash, are secretly hidden and randomly distributed to lucky customers who instantly win the prize award.

U.S. Pat. No. 6,230,474 to Giacomen discloses a method of manufacturing food packaging having a removable prize therein. Prizes are deposited at a predetermined spacing along a first sheet of plastic wrapping. The first sheet of plastic wrapping, with the prizes adhered thereto, is covered by a second sheet of plastic wrapping. A second surface of the first sheet, opposite the first surface, is folded over, or is covered by a third sheet of plastic wrapping, after food is placed on the second sheet.

U.S. Patent Application Publication No. 2003/0080015 to Kopecky discloses an improved product holding and dispensing package. In one embodiment, a package for a gum product includes information concerning giveaways, sweepstakes, contests, etc. The gum package includes a body defining opposing end walls. A tab attaches to the body, whereby a consumer can grasp the tab to remove one of the end walls. The removable end wall allows the consumer to remove a gum product from the body and also to view the giveaway information.

Thus, it has been known to provide packaging that provides a promotion material, prize, or giveaway. For many years, cereal boxes have contained small prizes. The prize induces some people to purchase and/or more quickly consume the product. Other consumable products come with coupons for the associated product. Coupons also induce the customer to buy the product and to repurchase the product at a later time using the coupon. Consumable products can also come with cash rebates, which induce purchasing. The prizes, coupons and rebates typically include a separate package or leaflet that inserts into a box with the product or between the box and an outer layer of packaging.

Soft drink packaging has also made use of the bottle cap to provide information about prizes and giveaways. Bottled soft drinks are sold through a variety of marketing channels including supermarket stores, convenience stores and vending machines. Not all of these channels use the same packaging. For instance, convenience stores and especially supermarkets package bottled soft drinks in twelve packs and cases, while vending machines dispense only single units of bottled soft drinks. To run a contest or sweepstakes including all bottled soft drinks, the bottles must themselves include the contest or sweepstakes information. Thus, placing the information inside the 12-pack or case container would exclude vending machine sales.

While bottled soft drinks have made use of the bottle cap for providing giveaway or sweepstakes information, confectionery packaging typically has not provided a viable technique for providing giveaway or sweepstakes information. One of the problems with providing a confectionery package, e.g., a chewing gum product having a foil wrapper, is that the foil is used to store the sticks of chewing gum until the entire product is consumed. Thus, if the giveaway information is contained on the inner body of the wrapper, the eager consumer is encouraged to destroy the housing to see the prize information and at the same time destroy the housing for the confectionery products, e.g., the sticks of chewing gum.

In spite of the above advances, there remains a need for improved packages for edible confectionery items such as gum balls, candies and mints, which enable individuals to improve their math skills and which provide each individual with a chance to win a prize.

SUMMARY OF THE INVENTION

In one embodiment of the present invention, a prize package preferably includes a plurality of edible confectionery items such as gum balls, tablet gum, candies, and/or mints. Each of the edible confectionery items (e.g., gum balls) preferably has a unique number provided thereon. The numbers on all of the edible items in the package are desirably added together to arrive at a "final number," which is then compared to a winning number or code provided on the package to determine whether a prize has been won. Prizes may be cash awards, TVs, bikes, stereos, computers, trips and the like. It is contemplated that a winning prize may include any type of monetary or material possession.

In one embodiment, a plurality of packages are provided for sale at retail establishments. Each package preferably includes a unique prize code incorporated therein. The prize code provides a separate, independent means, separate and apart from the numbers on the edible confectionery items, for determining whether a package is a "winner." Thus, the gum balls provide a first indication that a consumer has purchased a winning package, however, the code or indicia printed on the package provide a second and more official indication that the package is a winning package. The separate, independent printed code or indicia preferably provides the official, legal means for determining a winning package, which prevents consumers from attempting to engage in fraud by using edible confectionery items from different packages to obtain the final, winning number.

In one embodiment, a prize package containing edible confectionery items preferably includes a container, and a plurality of edible confectionery items disposed within the container. The edible confectionery items may be gum balls, gum sticks, tablet gum, candies or mints. In one embodiment, a number is provided on each of the edible confectionery items disposed within the container, and a reference number is provided inside the container. The numbers on the edible confectionery items may be printed on each of the items. The numbers on the edible confectionery items are desirably different from one another so that each item has a different number provided thereon.

In one embodiment, the prize package is a winning prize package if the sum total of the numbers provided on the edible confectionery items disposed within the container matches the reference number provided inside the container. The prize package may also include a validation code provided inside the container for confirming that the prize package is a winning prize package. The validation code may be a bar code, a number code, a QR code, and/or a scratch-off code. In one embodiment, the validation code may be verified using a mobile App or a website.

In one embodiment, the prize package has a plurality of confectionery item replicas provided in the container that have the same size and shape as the edible confectionery items disposed within the container. Each confectionery item replica desirably has a number printed thereon that matches one of the numbers provided on the edible confectionery items disposed within the container.

In one embodiment, the prize package may include a prize strip disposed within the container that has the confectionery item replicas provided thereon. In one embodiment, the reference number and/or the validation code are desirably provided on the prize strip.

In one embodiment, the container has a bottom wall having a top surface, and the plurality of confectionery item replicas are provided on the top surface of the bottom wall of the container.

In one embodiment, the container is a tube having a closed end and an open end that is covered by a cap. The edible confectionery items may be disposed inside the tube, and the reference number is provided inside the tube or on an underside of the cap.

In one embodiment, the prize package preferably includes an opaque sleeve disposed inside the tube that surrounds the edible confectionery items so that the edible confectionery items are not visible outside the container before the container is opened. The reference number may be printed on an inner surface of the opaque sleeve.

In one embodiment, a prize package containing edible confectionery items desirably includes a container, a plurality of gum pieces disposed inside the container, whereby each gum piece has a number provided thereon, a reference number provided inside the container, whereby the prize package is a winning prize package if the sum total of the numbers provided on the gum pieces disposed within the container matches the reference number provided inside the container, and a validation code provided inside the container for confirming that the prize package is a winning prize package.

In one embodiment, the container includes a tube having a closed end and an open end, and a cap covering the open end of the tube. An opaque sleeve may be disposed inside the tube and surround the gum pieces. The opaque sleeve may have a reference number printed on an inner surface thereof.

In one embodiment, a prize package containing edible confectionery items preferably includes a container, a plurality of edible confectionery items disposed within the container, a number printed on an outer surface of each edible confectionery item disposed within the container, and a prize strip disposed within the container, the prize strip having a plurality of confectionery item replicas provided thereon having the same size and shape as the edible confectionery items, whereby each confectionery item replica has a number associated therewith that matches one of the numbers provided on the edible confectionery items disposed within the container. In one embodiment, a reference number is provided inside the container. In one embodiment, the prize package is a winning prize package if the sum total of the numbers provided on the edible confectionery items disposed within the container matches the reference number provided inside the container.

In one embodiment, the container is preferably made of paper or plastic, and the edible confectionery items may be gum balls, gum sticks, tablet gum, candies and/or mints.

Although the present invention is not limited by any particular theory of operation, it is believed that providing numbers on the edible confectionery items will serve as a valuable learning tool for individuals seeking to improve their addition and mathematical abilities. It is contemplated that the system will be particularly interesting and valuable for young children learning to add numbers. In addition, the chance to win a prize will garner the keen interest and excitement of young and old alike. Both children and adults will also be intrigued with the chance to win a prize, even if the latter group has already mastered math and addition.

In one embodiment, a prize package may include a point value system. In one embodiment, a unique number or value will be associated with each prize package. In one embodiment, the unique number or value may be provided within an inside part of the package so that a customer will have to first purchase the product to find out the number and/or value of the package. In one embodiment, each prize package may have a barcode and/or QR code associated therewith, whereby the customer can establish a personal account and then scan and/or manually enter the number and/or value from the prize packages into a website (e.g., www.sumgum-co.corn) and/or a mobile device App (e.g., Sumgum App). In one embodiment, the accumulation of points on the customer's personal account may earn the customer prizes, such as if the customer reaches a certain target or level of points within a specific period of time. In one embodiment, the higher the point target, the greater the prize awarded to the customer.

The present invention contemplates that only a small percentage of the packages will be winning packages. The ratio of winning packages to non-winning packages may depend upon the value of the prizes to be won. Ratios of 10,000:1 or greater may be contemplated. In some embodiments, the ratio of winning to non-winning packages may be 10:1 (i.e., one winner out of 10 packages), 5:1 (i.e., one winner out of five packages), 3:1 (one winner out of three packages) or less. In one embodiment, the ratio of winning to non-winning packages may range from 2:1 to 10,000:1-25,000-1.

The present invention is not intended to establish or support a vehicle or system for ongoing gambling or gaming. It is contemplated that the promotional game disclosed herein will be conducted on a limited and occasional basis as an advertising and marketing tool to promote sales of the edible confectionery items disclosed herein. In one embodiment, the promotional game will be conducted on a limited basis during summer months only when students are out of school so that the students can maintain and refresh their math skills. In this embodiment, the promotional game will not be conducted during the school year. In a second embodiment, the promotional game will be conducted during the school year only, and will not be conducted during the summer vacation period, to assist students in learning math.

These and other preferred embodiments of the present invention will be described in more detail herein.

DETAILED DESCRIPTION

Figure 1:
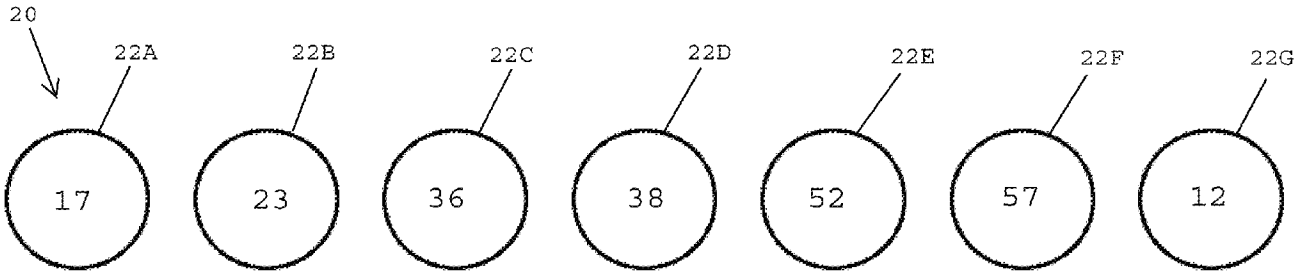
FIG. 1 shows a plurality of gum balls having numbers provided thereon, in accordance with one embodiment of the present invention.

Referring to FIG. 1, in one embodiment, a prize package 20 preferably includes a plurality of gum balls 22A-22G. Each of the gum balls 22A-22G desirably has a unique and distinct number provided thereon. Each of the gum balls 22A-22G, including the number provided thereon, is edible. In other embodiments, the gum balls may be replaced by other types of confectionery items having unique numbers provided thereon, such as candies, mints, gum sticks, and tablet gum.

In the FIG. 1 embodiment, the numbers provided on the gum balls 22A-22G add up to a final total number of 235. In one embodiment, the gum balls are preferably used by individuals, such as children, to practice math and addition. In one embodiment, a prize is awarded if the total number for all of the gum balls matches a number that is provided on a package, or the winning number on the package matches the gum ball number.

Figure 2:
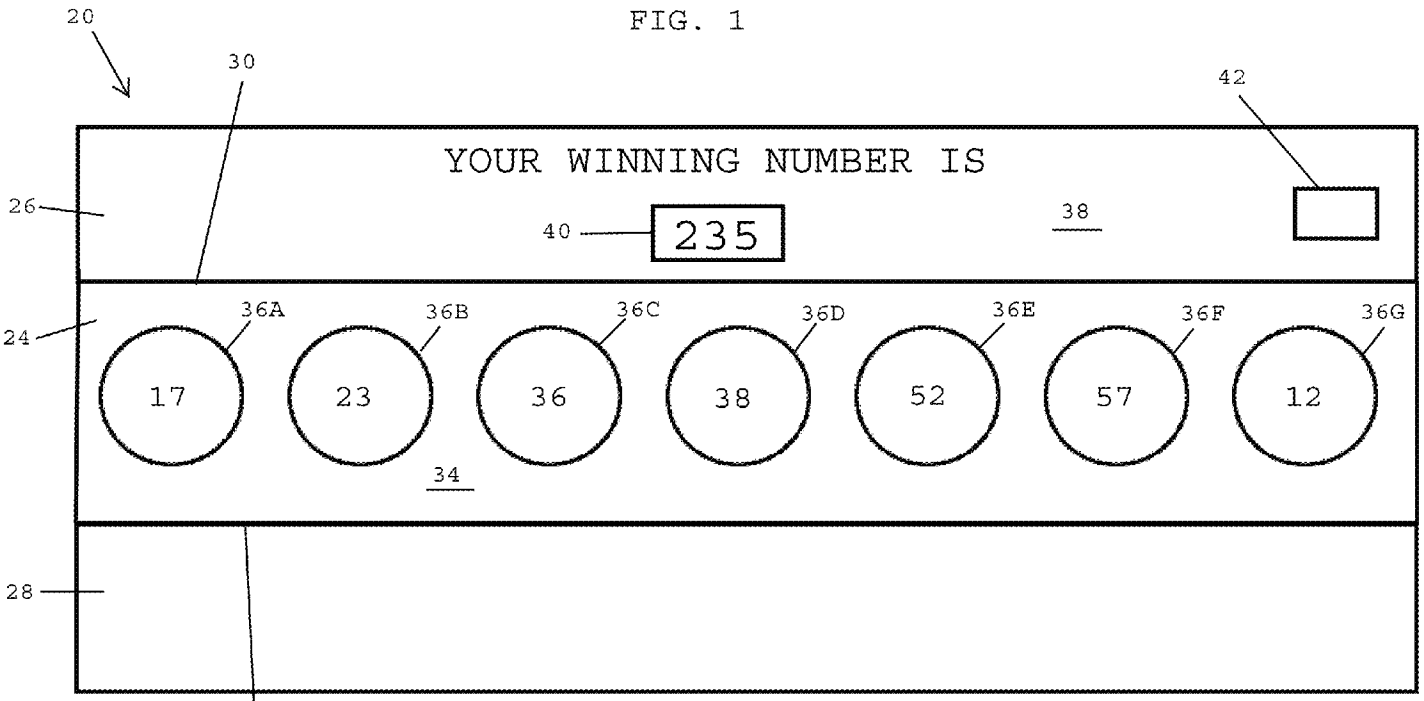
FIG. 2 shows a prize package that is designed to contain the gum balls shown in FIG. 1, in accordance with one embodiment of the present invention.

Referring to FIG. 2, in one embodiment, the prize package 20 preferably includes a bottom wall 24, a first side wall 26, and a second side wall 28. A first fold line 30 extends between the first side wall 26 and the bottom wall 24, and a second fold line 32 extends between the second side wall 28 and the bottom wall 24. In one embodiment, the fold lines enable the package to be folded into an elongated package having a U-shape or a triangular shape when viewed in cross-section. The top surface 34 of the bottom wall 24 preferably has gum ball replicas 36A-36G printed thereon. In one embodiment, the gum ball replicas 36A-36G desirably have the same general shape and size as the edible gum balls 22A-22G shown in FIG. 1, and each of the gum ball replicas 36A-36G has a number printed thereon that matches one of the numbers shown on the gum balls 22A-22G of FIG. 1. In one embodiment, an individual, such as a child, will match the numbers on the gum balls with the numbers on the gum ball replicas.

In one embodiment, the inner surface 38 of the first side flap 26 has printed thereon a winning number, which is designated by reference number 40. In the particular embodiment shown in FIG. 2, the winning number is 235. In order to win, the numbers on the gum balls are added together and a prize is won if the total number for the gum balls matches the number, designated by reference number 40, shown on the inner surface 38 of the first side flap 26. In another preferred embodiment, a consumer will win if a number on a gum ball matches the winning number. In one embodiment, the inner surface 38 of the first side flap 26 preferably includes a code area 42 that has printed thereon one or more codes including a bar code, a number code, a QR code, and/or a scratch-off code that may be used to confirm whether the package 20 is a prize winning package. In one embodiment, a user may check the code at a static display at a store to confirm if a prize has been won. In another embodiment, a user may log into a website and enter code information to determine if a prize has been won. The code area 42 provides the official indication of whether a package is a prize winning package. In one embodiment, a mobile device application may be used for redeeming a prize.

Figure 3:
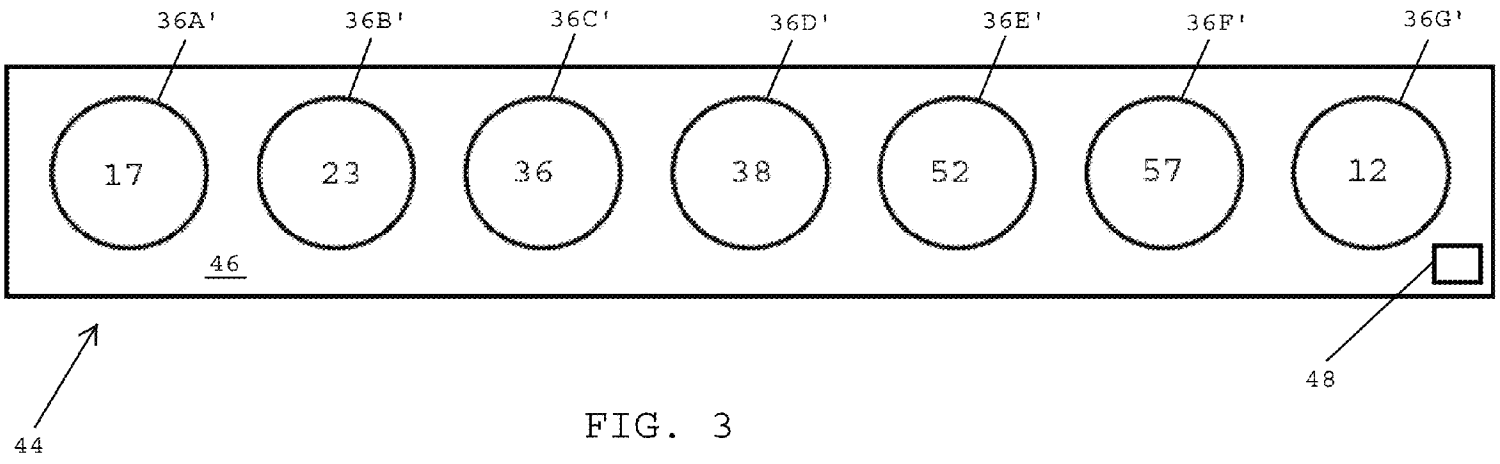
FIG. 3 shows a prize strip that is contained within the prize package shown in FIG. 1, in accordance with one embodiment of the present invention.

Referring to FIG. 3, in one embodiment, a prize package 20 (FIG. 2) preferably includes a prize strip 44 that is adapted to be positioned over the top surface 34 of the bottom wall 24 of the package. The top surface 46 of the prize strip 44 has gum ball replicas 36A'-36G' printed thereon. The gum ball replicas 36A'-36G' have the same general shape as the gum balls 22A-22G shown in FIG. 1, and each of the gum ball replicas 36A'-36G' has a number printed thereon that matches one of the numbers shown on the gum balls 22A-22G of FIG. 1.

In one embodiment, the prize strip 44 is a separate piece of packaging that may be easily removed from an opened prize package 20 (FIG. 2) for confirming if a prize has been won. In one embodiment, the prize strip 44 desirably includes a code area 48 that has one or more codes provided thereon such as a bar code, a number code, a QR code, and/or a scratch-off code that may be used to confirm whether the prize package 20 is a prize winning package. As described for the FIG. 2 embodiment, a user may check the code information 48 at a static display or a website to determine if a prize has been won. In one embodiment, the code area 48 on the prize strip 44 provides the official indication of whether a package is a prize winning package.

Figure 4:
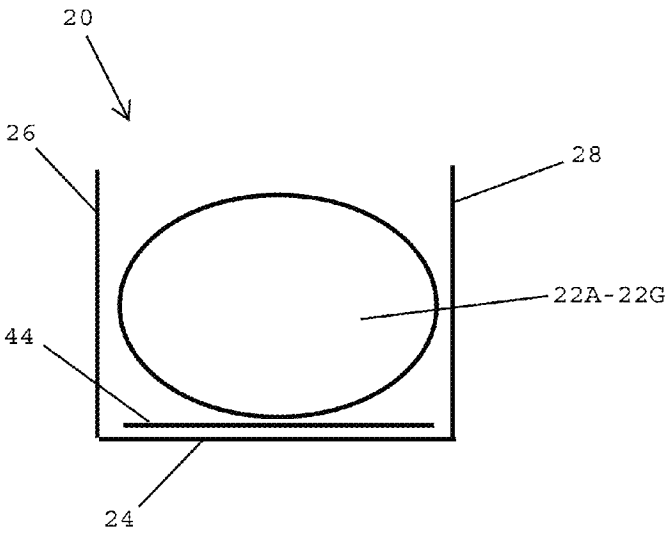
FIG. 4 shows a cross-sectional view of the prize package of FIG. 2, with the gum balls of FIG. 1 and the prize strip of FIG. 3 disposed within the prize package.

Referring to FIG. 4, in one embodiment, a prize package 20 preferably includes a prize strip 44 positioned over a bottom wall 24 of the prize package. A plurality of gum balls 22A-22G are positioned atop the prize strip 44. The prize package 20 is then closed by folding the first and second side walls 26, 28 toward one another so that the outer edges of the respective first and second side walls 26, 28 contact one another.

The prize package 20 is preferably sold to consumers in the configuration shown in FIG. 4. Before purchasing and opening the package 20, a consumer has no way of knowing if the package is a winning package. In one embodiment, after opening the package 20, a user adds up the numbers that are printed on the gum balls 22A-22G to obtain a total number. The user then compares the total number with the winning number printed on the inside of the first side wall 26 of the package. The consumer may also use the code information 42 (FIG. 2) on the first side wall 26 or the code information 48 (FIG. 3) on the prize strip 44 for confirming whether the package is a prize winning package. As noted above, the code area 42 on the first side wall 26 and/or the code area 48 on the prize strip 44 provides the official, legal indication of whether a package is a prize winning package.

Figure 5:
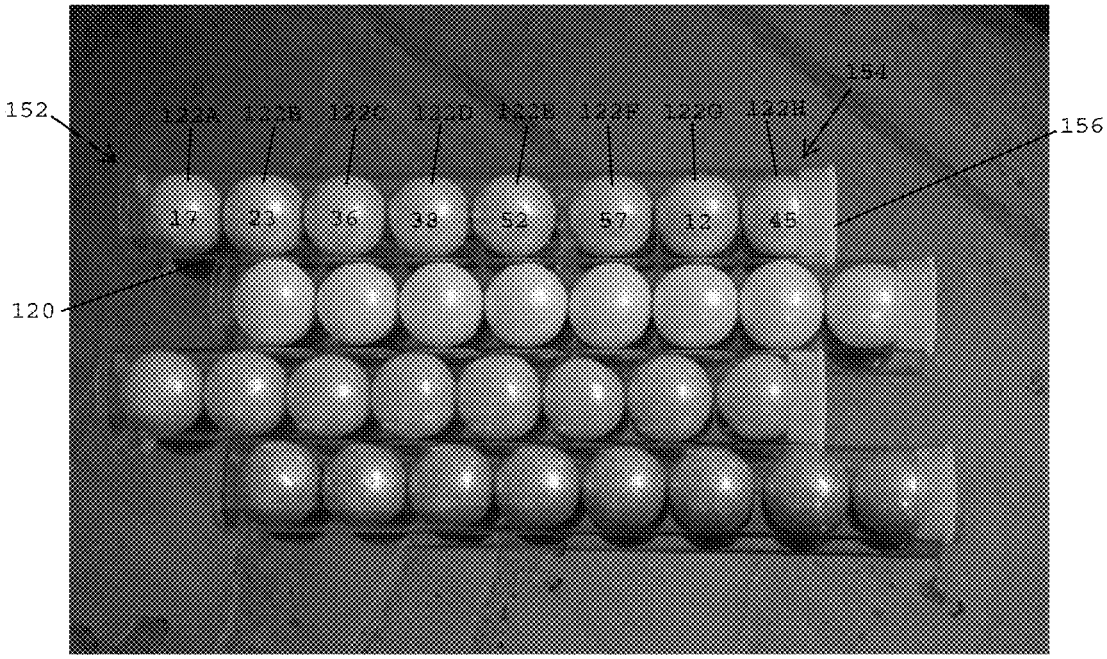
FIG. 5 shows prize packages for gum balls including elongated tubes and caps for closing the open ends of the elongated tubes.

Referring to FIG. 5, in one embodiment, a prize package 120 preferably includes an elongated tube 150 having a closed end 152 and an open end 154. The open end 154 of the elongated tube may be covered by a cap 156. The cap may be removed for accessing the gum balls through the open end 154 and then re-inserted into the open end 154 for again closing the package. A plurality of gum balls 122A-122H are loaded into each elongated tube 150. Each of the gum balls 122A-122H preferably has a unique, distinct number printed thereon. The underside of the cap 156 preferably has prize information provided thereon that enables a consumer to determine if the package is a prize winning package. The information on the cap may be a code, a number, a scratch-off or any other type of information that may be used to determine if a prize has been won. In FIG. 5, for simplicity, only one of the packages has numbered gum balls. It is contemplated that in at least one embodiment, all of the gum balls will have a unique number provided thereon.

Figure 6:
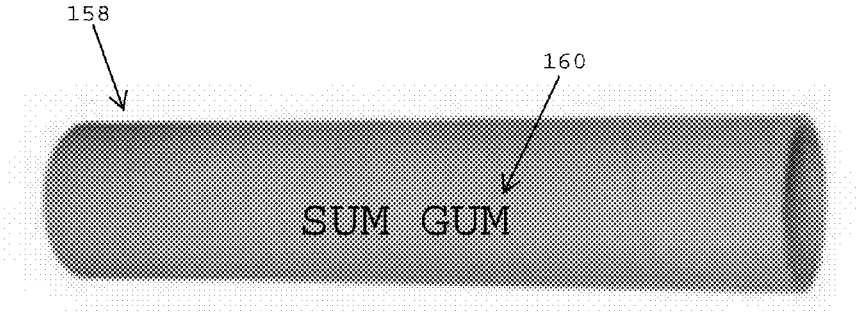
FIG. 6 shows an opaque tube or sleeve placed inside the elongated tubes shown in FIG. 5.

Referring to FIG. 6, in one embodiment, a flexible tube 158, such as an opaque paper tube, is placed inside the elongated tube 150 so that a consumer cannot see the gum balls inside the package 120 (FIG. 5). A product name 160 may be printed on the outer surface of the opaque paper tube 158. The inner surface of the opaque paper tube 158 may contain information for determining if a package is a prize winning package. The paper tube will enable the consumers to see the numbers on the gum balls but the consumer will not be able to see the winning number until removing the cap from the elongated tube.

Figure 7:
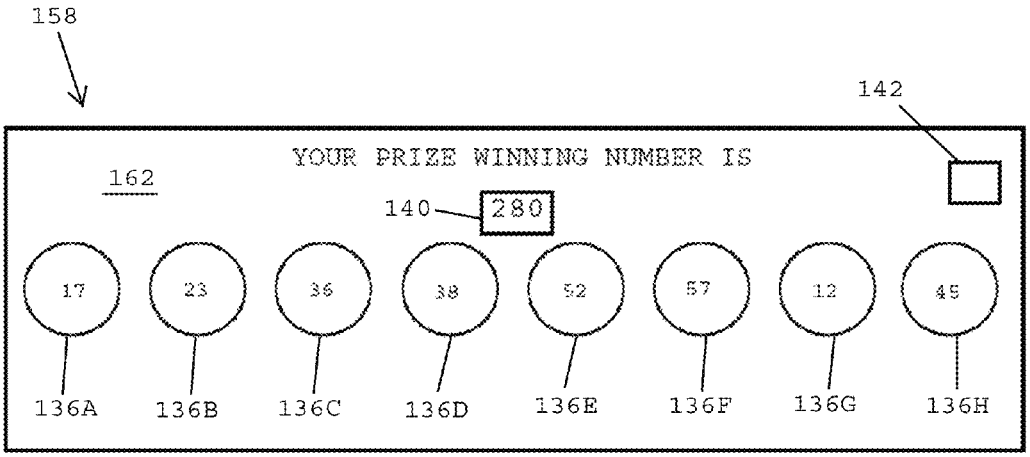
FIG. 7 shows the opaque tube of FIG. 6 after being unfurled to reveal prize information provided on an inner surface of the tube, in accordance with one embodiment of the present invention.

Referring to FIG. 7, in one embodiment, the opaque paper tube 158 preferably has an inner surface 162 having gum ball replicas 136A-136H printed thereon. The gum ball replicas 136A-136H have the same general shape and size as the gum balls 122A-122H shown in FIG. 5, and each of the gum ball replicas 136A-136G has a number printed thereon that matches one of the numbers provided on the respective gum balls 122A-122H shown in FIG. 5.

In one embodiment, the inner surface 162 of the opaque paper tube 158 has printed thereon a winning number, designated by reference number 140. In the particular embodiment shown in FIG. 2, the winning number is 280. In order for a consumer to win, the numbers on the gum balls are added together and a prize is won if the total number for the gum balls matches the number, designated by reference number 140, shown on the inner surface 162 of the opaque tube 158. In one embodiment, the inner surface 162 of the opaque paper tube 158 preferably includes a code area 142 that has printed thereon one or more codes that may be used to confirm whether the package 120 (FIG. 5) is a prize winning package such as a bar code, a number code, a QR code, and/or a scratch-off code. In one embodiment, a user may check the code at a static display at a store or via a website to determine if a prize has been won. In another embodiment, a user may log onto a website and enter code information to determine if a prize has been won.

Figure 8:
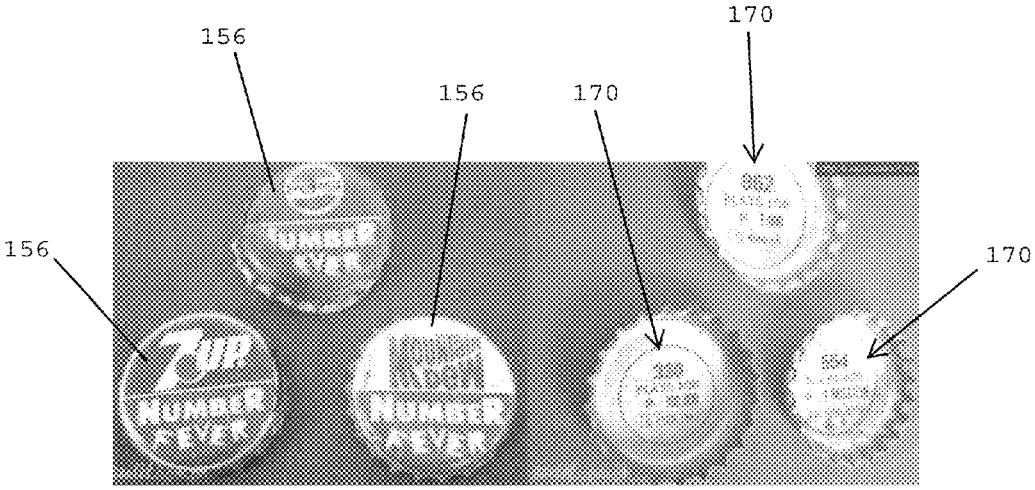
FIG. 8 shows caps for containers having prize information provided on the undersides of the caps, in accordance with one embodiment of the present invention.

FIG. 8 shows caps 156 having winning number information 170 printed on the undersides of the caps. The caps may be plastic or metal. The caps may be hinged to the tube or may be screw on caps. The caps 156 are only exemplary in nature in order to provide an example of how the caps 156 shown in FIG. 5 may be used for determining prize winners.

As noted above, various types of codes may be utilized for determining prize winners. The codes may be provided in various locations on a package including the bottom wall 24 of a package 20 as shown in FIG. 2, a top surface 46 of a prize strip 44 as shown in FIG. 3, the inner surface 162 of an opaque paper tube 158 as shown in FIG. 7 and/or the underside of a cap 156 as shown in FIG. 8.

Figure 9:
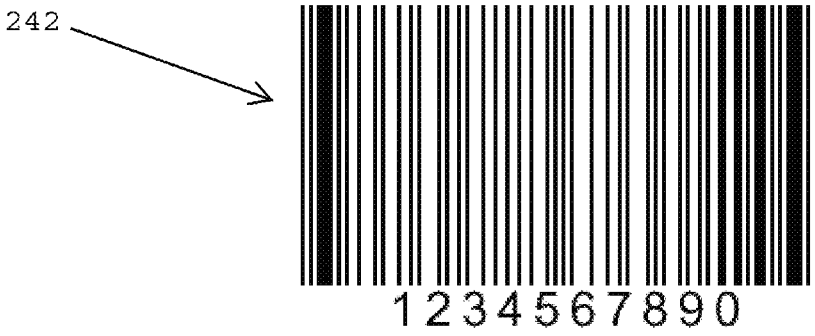
FIG. 9 shows a bar code for providing prize information on a package, in accordance with one embodiment of the present invention.

Referring to FIG. 9, in one embodiment, the code for determining a prize winner preferably includes a bar code 242 that may be provided at one or more places on a package.

Figure 10:
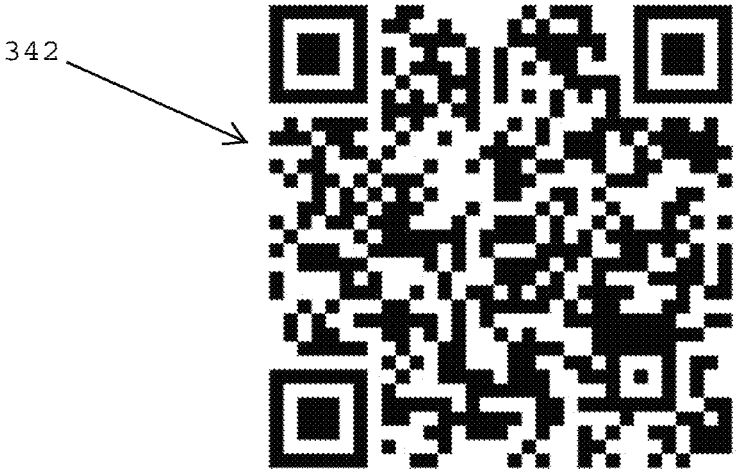
FIG. 10 shows a QR code for providing prize information on a package, in accordance with one embodiment of the present invention.

Referring to FIG. 10, in one embodiment, the code for determining a prize winner preferably includes a QR code 342 that may be provided at one or more places on a package.

Figure 11:
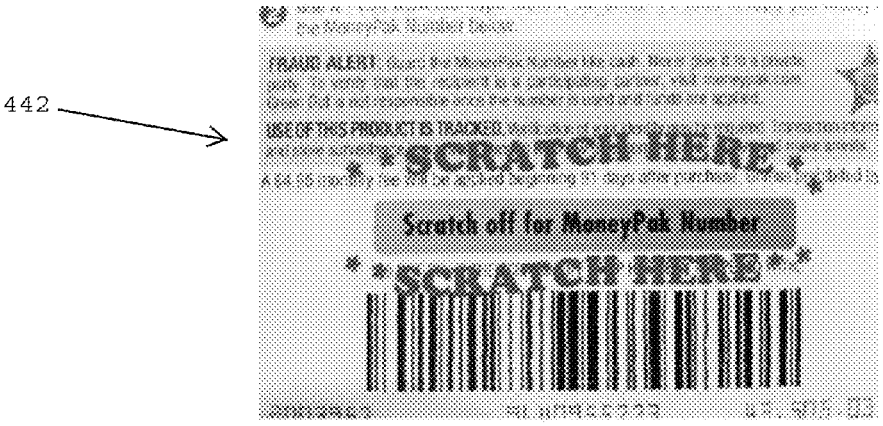
FIG. 11 shows a scratch-off element used for providing prize information on a package, in accordance with one embodiment of the present invention.

Referring to FIG. 11, in one embodiment, the code for determining a prize winner preferably includes a scratch-off section 442 that may be provided at one or more places on a package.

Figure 12:
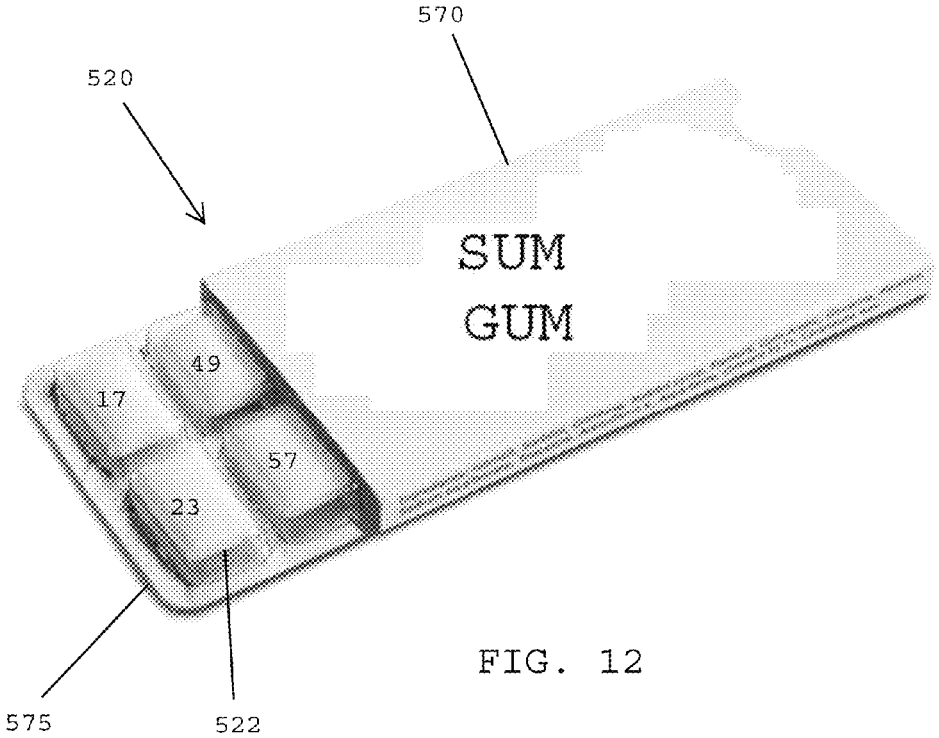
FIG. 12 shows a blister pack for tablet gum including an outer container, in accordance with one embodiment of the present invention.

In one embodiment, blister packs may be used as prize packages. Referring to FIG. 12, in one embodiment, a prize package 520 preferably includes an outer container 570 and a blister pack container 575 that is disposed within the outer container 570. The blister pack 575 desirably contains a plurality of tablet gum elements 522, each tablet gum element having a unique number provided thereon. The blister pack 575 is preferably disposed within or carried in the outer container. In one embodiment, the outer container contains the winning number or prize code. The numbers on the tablet gum are used to determine if the package is a winning package. Codes on the outer container may be used to redeem prizes or coupons. In one embodiment, the outer container 570 may open like a book.

In one embodiment, each package has a point value. The point value, via scanning of a QR code, barcode or manual submission of pack identity, is uploaded to a SumGum App or a website—www.sumgumco.com. The points are preferably loaded into a customer's account and function as loyalty points used in a loyalty program. After a certain number of points are attained from purchasing Sum Gum products, a customer may claim his or her prize. In one embodiment, prizes can be redeemed after the numbers of points collected reaches or exceeds a certain target. As more and more points are accumulated, the customer becomes eligible for better prizes such as another pack of SumGum, SumGum t-shirts, and more. After redeeming a prize via the App or an online website, the number of points in a user account will be reduced to reflect the number of points used to obtain a prize. In one embodiment, the packs may only be used once. After the points have been added to an account or used to redeem a prize, the package cannot be used by another party.

Figure 13:
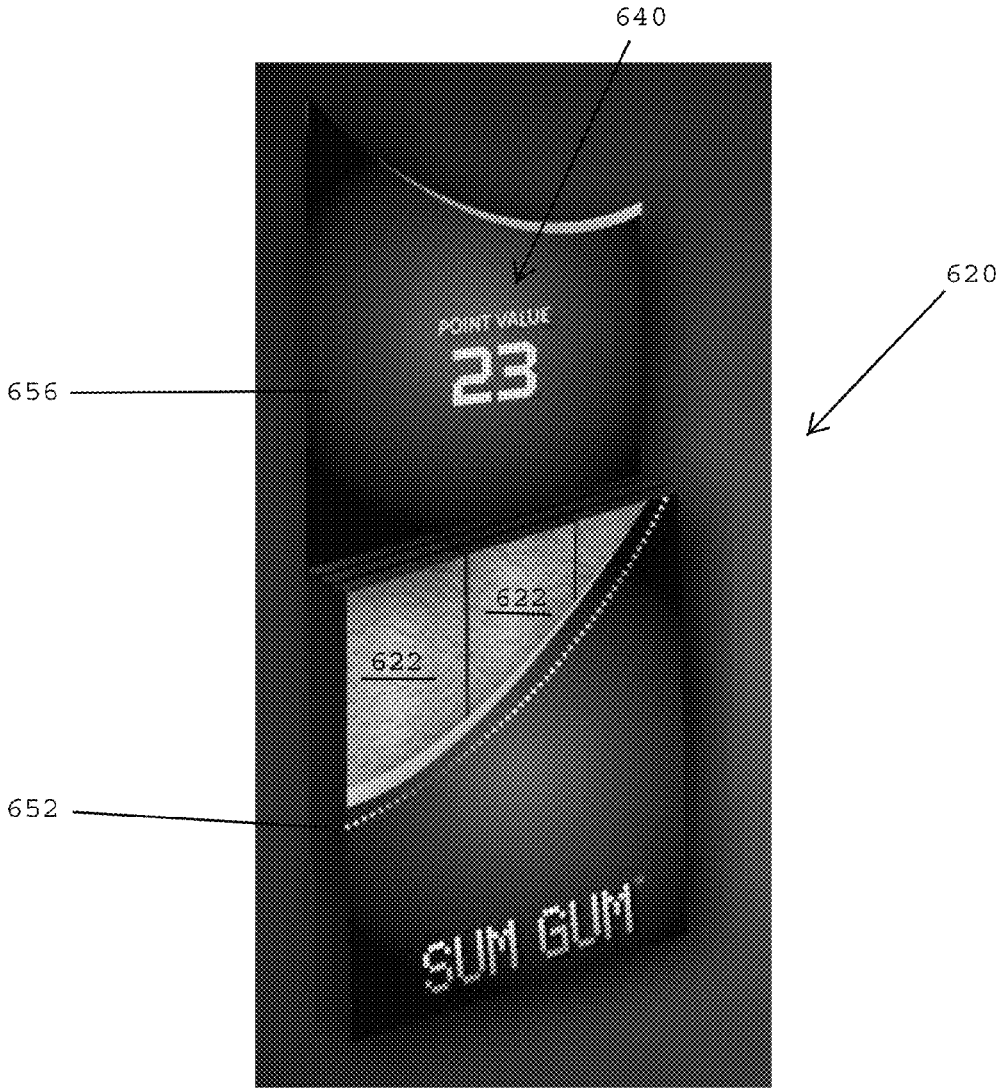
FIG. 13 shows prize packages for gum sticks including a flip open top, in accordance with one embodiment of the present invention.

Referring to FIG. 13, in one embodiment, a prize package 620 preferably includes a package housing 652 having an open upper end and a plurality of gum sticks 622 packed therein. The prize package 620 has a flip open top 656 that is closed over the gum sticks 622 and inserted into the open upper end of the package housing 652. The inner face of the flip open top 656 preferably has a section 640 that provides a point value. The section 640 may be a scratch off section for revealing the point value. In one embodiment, a user may log into a website or use a mobile App to submit the point value to a user account for accumulating prize points and/or to redeem prizes using the prize points.

The present invention disclosed herein is not intended to establish or support a vehicle or system for ongoing gambling or gaming. It is contemplated that the promotional game disclosed herein will be conducted on a limited and occasional basis as an advertising and marketing tool to promote sales of the edible confectionery items disclosed herein.

While the foregoing is directed to embodiments of the present invention, other and further embodiments of the invention may be devised without departing from the basic scope thereof, which is only limited by the scope of the claims that follow. For example, the present invention contemplates that any of the features shown in any of the embodiments described herein, or incorporated by reference herein, may be incorporated with any of the features shown in any of the other embodiments described herein, or incorporated by reference herein, and still fall within the scope of the present invention.

What is claimed is:

1. A prize package containing edible confectionery items comprising:

a container;

a plurality of edible confectionery items disposed within said container;

a number provided on each of said edible confectionery items disposed within said container;

a reference number provided inside said container, wherein said reference number is printed on a surface of said container, and wherein said prize package is a winning prize package if the sum total of the numbers provided on said edible confectionery items disposed within said container matches the reference number printed on said surface of said container;

wherein said prize package has a plurality of confectionery item replicas provided in said container that have the same size and shape as said edible confectionery items disposed within said container, wherein each said confectionery item replica has a number printed thereon that matches one of the numbers provided on said edible confectionery items disposed within said container, wherein said prize package further comprises a prize strip disposed within said container that has said confectionery item replicas provided thereon.

2. The prize package as claimed in claim 1, further comprising a validation code provided inside said container for confirming that said prize package is a winning prize package.

3. The prize package as claimed in claim 2, wherein said validation code is selected from the group consisting of a bar code, a number code, a QR code, and a scratch-off code.

4. The prize package as claimed in claim 3, wherein said validation code is verified using a mobile App or a website.

5. The prize package as claimed in claim 2, wherein at least one of said reference number and said validation code are provided on said prize strip.

6. The prize package as claimed in claim 1, wherein said container comprises a bottom wall having a top surface, and wherein said plurality of confectionery item replicas are provided on said top surface of said bottom wall of said container.

7. The prize package as claimed in claim 1, wherein said edible confectionery items are selected from the group consisting of gum balls, gum sticks, tablet gum, candies and mints.

8. The prize package as claimed in claim 1, wherein said numbers are printed on outer surfaces of said respective edible confectionery items.

9. The prize package as claimed in claim 1, wherein said container comprises a tube having a closed end and an open end that is covered by a cap, wherein said edible confectionery items are disposed inside said tube, and wherein said reference number is provided inside said tube or on an underside of said cap.

10. The prize package as claimed in claim 9, further comprising an opaque sleeve disposed inside said tube that surrounds said edible confectionery items so that said edible confectionery items are not visible outside said container before said container is opened, wherein said reference number is printed on an inner surface of said opaque sleeve.

11. The prize package as claimed in claim 1, wherein at least two or more of said numbers provided on said edible confectionery items are different from one another.

12. A prize package containing edible confectionery items comprising:

a container;

a plurality of edible confectionery items disposed within said container;

a number printed on an outer surface of each said edible confectionery item disposed within said container;

a prize strip disposed within said container, said prize strip having a plurality of confectionery item replicas provided thereon having the same size and shape as said edible confectionery items, wherein each said confectionery item replica has a number associated therewith that matches one of said numbers provided on said edible confectionery items disposed within said container;

a reference number provided inside said container, wherein said prize package is a winning prize package if the sum total of said numbers provided on said edible confectionery items disposed within said container matches the reference number provided inside said container.

13. The prize package as claimed in claim 12, wherein said container is made of paper or plastic, and wherein said edible confectionery items are selected from the group consisting of gum balls, gum sticks, tablet gum, candies and mints.

* * * * *